United States Patent [19]

Kondo

[11] Patent Number: 4,676,679

[45] Date of Patent: Jun. 30, 1987

[54] RECORDING APPARATUS

[75] Inventor: Hiroatsu Kondo, Zushi, Japan

[73] Assignee: Canon Kabushiki Kaisha, Tokyo, Japan

[21] Appl. No.: 813,267

[22] Filed: Dec. 24, 1985

[30] Foreign Application Priority Data

Dec. 28, 1984 [JP] Japan ..... 59-274316
Apr. 17, 1985 [JP] Japan ..... 60-80072

[51] Int. Cl.[4] ..... B41J 35/14; B41J 35/20

[52] U.S. Cl. ..... 400/211; 400/54; 400/215.3; 400/247; 400/249

[58] Field of Search ..... 400/54, 208, 211, 215.3, 400/668, 247, 249

[56] References Cited

U.S. PATENT DOCUMENTS

| | | | |
|---|---|---|---|
| 1,929,448 | 10/1933 | Ritz | 400/215.3 |
| 4,119,385 | 10/1978 | Watanabe et al. | 400/215.3 |
| 4,340,315 | 7/1982 | Teichmann et al. | 400/668 |
| 4,469,454 | 9/1984 | Crean | 400/208 |

FOREIGN PATENT DOCUMENTS

| | | | |
|---|---|---|---|
| 2503017 | 7/1975 | Fed. Rep. of Germany | 400/215.3 |
| 71185 | 4/1983 | Japan | 400/54 |
| 54587 | 3/1984 | Japan | 400/54 |

OTHER PUBLICATIONS

Purcell et al, "Daisy Wheel . . . Visibility", IBM Technical Disclosure Bulletin, vol. 25, No. 4, pp. 2157–2158, 9/82.

*Primary Examiner*—William Pieprz
*Attorney, Agent, or Firm*—Fitzpatrick, Cella, Harper & Scinto

[57] ABSTRACT

A recording apparatus comprises recording means for recording on a recording medium through an ink ribbon in accordance with a predetermined system, means for covering the recording means such that the cover means is free to open or close, and means, interlocked with an opening/closing operation of the cover means, for shifting the ink ribbon from a first position to a second position when the cover means is opened.

5 Claims, 8 Drawing Figures

RECORDING APPARATUS

BACKGROUND OF THE INVENTION

1. Field of the Invention

The present invention relates to a recording apparatus and, more particularly, to a recording apparatus which has a recording means for recording on a recording medium through an ink ribbon in accordance with a predetermined system, and a cover means for covering the recording means such that the cover means can be opened or closed.

2. Description of the Prior Art

In conventional recording apparatuses for recording on a recording medium through an ink ribbon in accordance with a predetermined system, in order to allow easy replacement of the ink ribbon, a cover which is free to open or close is arranged on the recording head. However, it is strongly desired that replacement of the ink ribbon be further facilitated.

In recording apparatuses such as typewriters, printing is performed in accordance with the operator's operation, and the operator must be able to confirm printing results. In order to allow this, the ink ribbon is removed from the printing position after each printing operation so as to allow the operator to confirm the printing result. However, recently, in consideration of ease in ink ribbon replacement, an ink ribbon is housed in a ribbon cassette, and the cassette is replaced instead of replacing the ribbon itself. With this arrangement, the overall cassette is pivoted and the ribbon is shifted.

When the overall cassette is pivoted using a solenoid or the like, the operation noise is large, and power consumption is increased. In view of this, an arrangement is proposed wherein the ribbon cassette is kept in position, but the ribbon drawn outside the cassette is vertically shifted by an arm or the like. With this arrangement, the ribbon drawn outside the cassette is located at a fixed position below the printing position by the arm in the non-printing mode. Only in the printing mode, the ribbon is shifted up to the printing position.

In an apparatus adopting the above arrangement, when the ribbon is replaced, the operator must access and remove, from the arm, the ink ribbon shifted down to a position below the printing position behind the mechanism parts. In many conventional apparatuses, a lever mechanism is interlocked with the shift arm of the ink ribbon. In order to replace the ink ribbon, the lever is operated to shift the ink ribbon upward and remove it from the arm. In an apparatus of this type, replacement is cumbersome and an extra shift mechanism is required as compared to an apparatus wherein the overall ribbon cassette is replaced.

SUMMARY OF THE INVENTION

It is an object of the present invention to provide a recording apparatus which allows easy replacement of an ink ribbon.

It is another object of the present invention to electrically interlock the opening/closing operation of a cover means with a shift operation of the ink ribbon.

It is still another object of the present invention to interlock the opening/closing operation of the cover means and the shift operation of the ink ribbon and to reduce the number of individual drive sources.

It is still another object of the present invention to bias an ink ribbon at a second position by a spring member, and to shift the ink ribbon from the second position to a first position upon closure of the cover means, so that the structure is simplified.

It is still another object of the present invention to allow easy ribbon replacement in a recording apparatus of the type wherein the cassette is not shifted.

It is still another object of the present invention to provide another ribbon shift means.

It is still another object of the present invention to allow an ink ribbon loaded at a position which can be easily accessed to be automatically moved to a normal position upon closure of the cover means.

It is still another object of the present invention to provide a recording apparatus which detects opening/-closing operation of the cover means by a detecting means, and the ink ribbon is automatically shifted in synchronism with opening/closing operation of the cover means detected by the detecting means.

It is still another object of the present invention to allow a shift means operative in synchronism with opening/closing operation of the cover means to serve as a shift means for shifting the ink ribbon between the printing operation position and the printing standby position in the recording mode.

It is still another object of the present invention to allow easy replacement of an ink ribbon of the type housed in a cassette.

It is still another object of the present invention to provide the replacement position of the ink ribbon which is identical to the printing operation position, so that the overall apparatus construction is simplified.

It is still another object of the present invention to allow easy replacement of the ink ribbon.

The above and other objects, features and advantages of the present invention will become apparent from the following description when taken in conjunction with the accompanying drawings.

BRIEF DESCRIPTION OF THE DRAWINGS

FIGS. 1 to 4 show a first embodiment of the present invention, in which

FIG. 1 is a perspective view showing the outer appearance of a typewriter according to this embodiment, FIG. 2 is a perspective view showing the outer appearance of a hood open state of the apparatus shown in FIG. 1, and FIGS. 3 and 4 are side views showing the construction near the carriage in the apparatus shown in FIG. 2; and FIGS. 5 to 8 show a second embodiment of the present invention, in which FIG. 5 is a perspective view showing the overall construction of a main part of the apparatus, FIG. 6 is a side view showing the interlocking state of an actuating lever, FIG. 7 is a side view showing an ink ribbon in the shifted-down state, and FIG. 8 is a side view showing the ink ribbon in the shifted-up state.

DETAILED DESCRIPTION OF THE PREFERRED EMBODIMENTS

The present invention will be described in more detail with reference to the accompanying drawings. In the description to follow, the present invention is applied to typewriters using daisy wheel printers.

Figure 1:
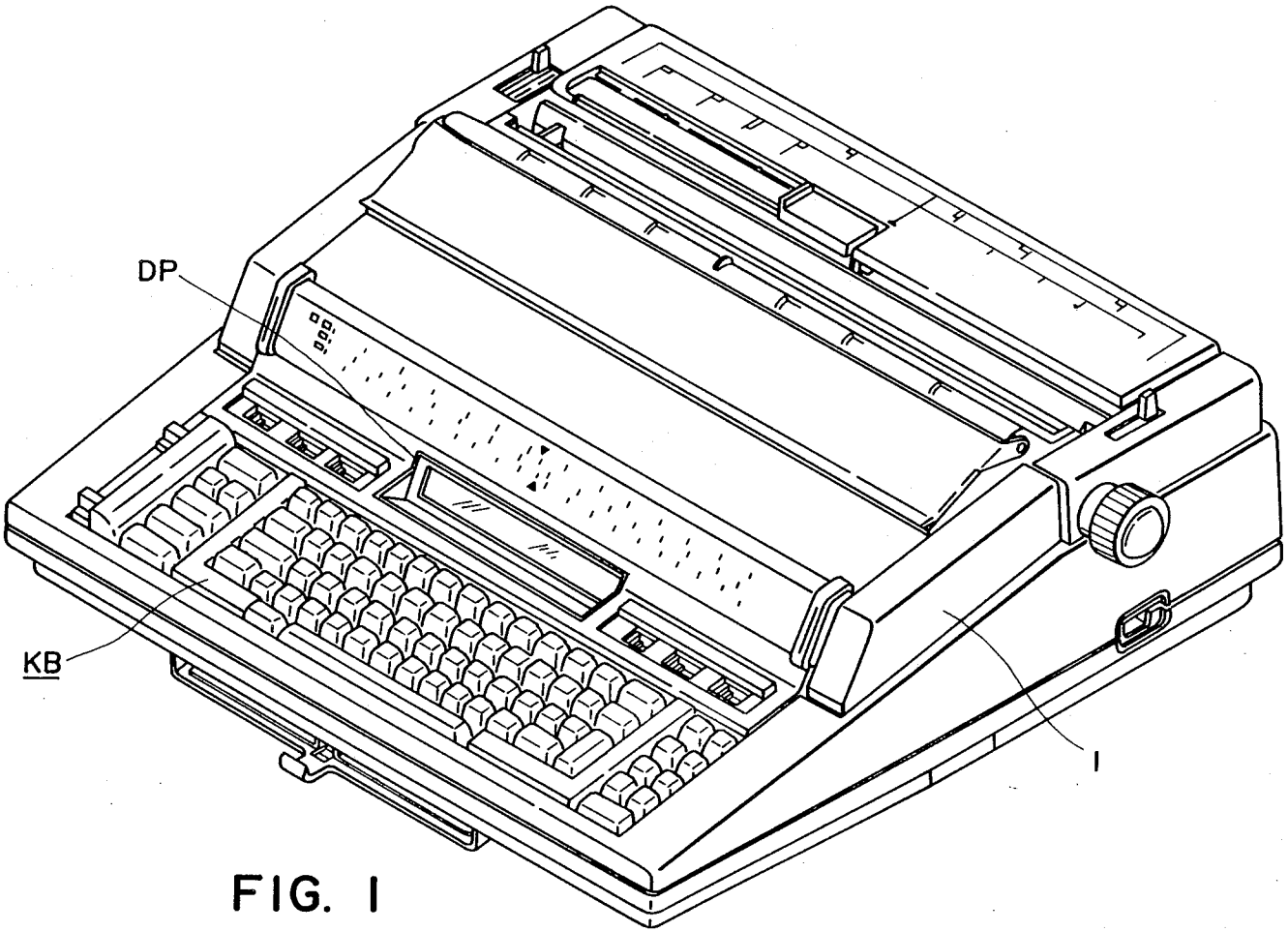

FIG. 1 is a perspective view showing the outer appearance of a typewriter according to a first embodiment of the present invention. The typewriter illustrated has constituent members similar to those in a conventional typewriter. More specifically, the typewriter has a keyboard KB on a housing, a display DP comprising an LCD or the like next to the keyboard KB, and a daisy wheel housed below a hood (cover) 1.

Characters input at the keyboard KB are supplied to a control circuit (not shown) in the housing. The control circuit drives a recording mechanism to print characters on printing paper.

Figure 2:
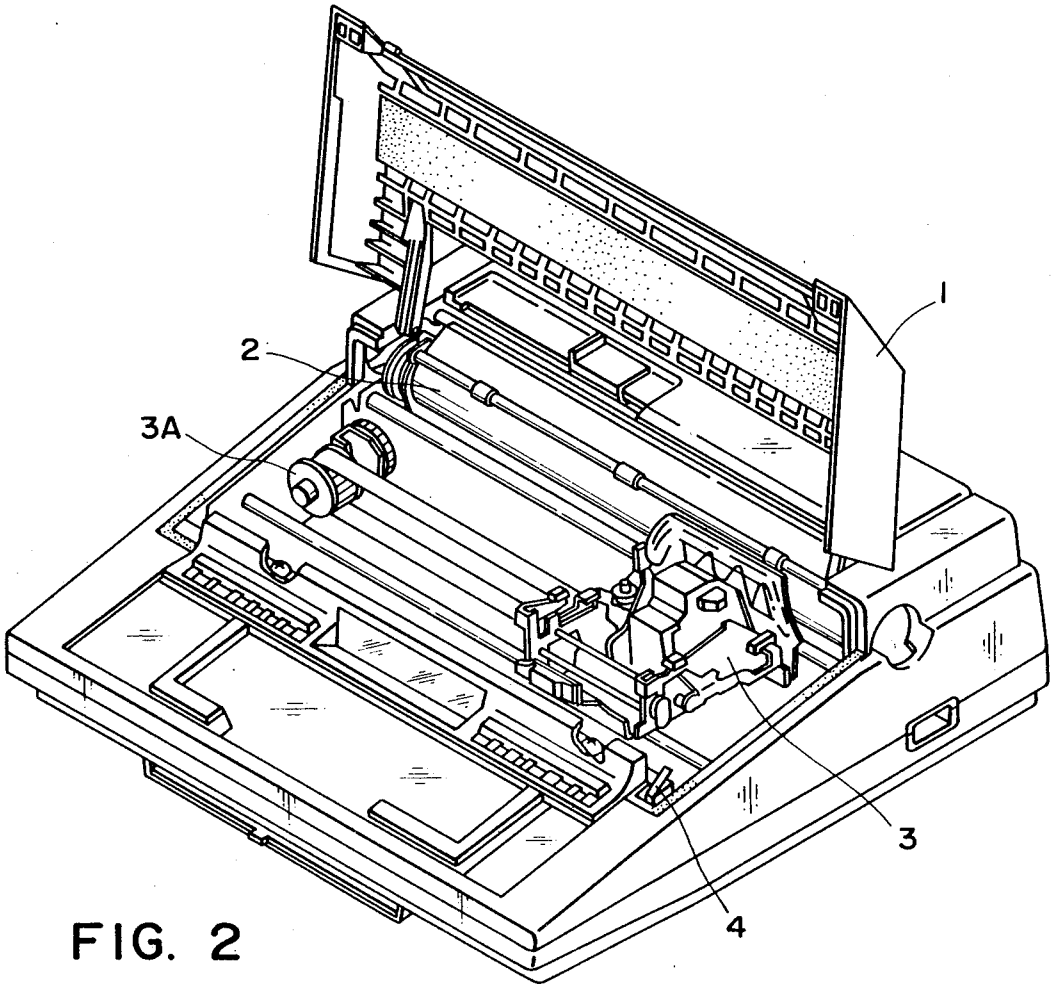

The hood 1 is pivotally supported with respect to the housing. When the typewriter must be inspected for maintenance or the ink ribbon is replaced with a new one, the hood 1 can be opened. When the hood 1 is opened as shown in FIG. 2, a recording mechanism having a platen 2 and a carriage 3 mounting a recording means is exposed. The carriage 3 is moved left to right or vice versa along the platen 2 through a belt and pulley mechanism 3A. The recording means prints on printing paper wound around the platen 2. FIG. 2 shows a state in which members such as the keyboard unit and the platen knob are removed.

In this embodiment, a switch 4 for detecting the open/closed state of the hood 1 is arranged at a right front portion of the housing region normally closed by the hood 1.

The hood 1 is incorporated so as to shield operating noise and to provide a good outer appearance. During operation, the hood 1 is closed, as shown in FIG. 1. When the printer is printing at high speed, if the operator touches the mechanism, he may become hurt. Therefore, if the hood 1 is open, the operation of the printer is preferably inhibited. Conventional apparatuses have hoods for this purpose.

In this embodiment, the hood 1 is also used for controlling the ink ribbon shift mechanism.

Figure 3:
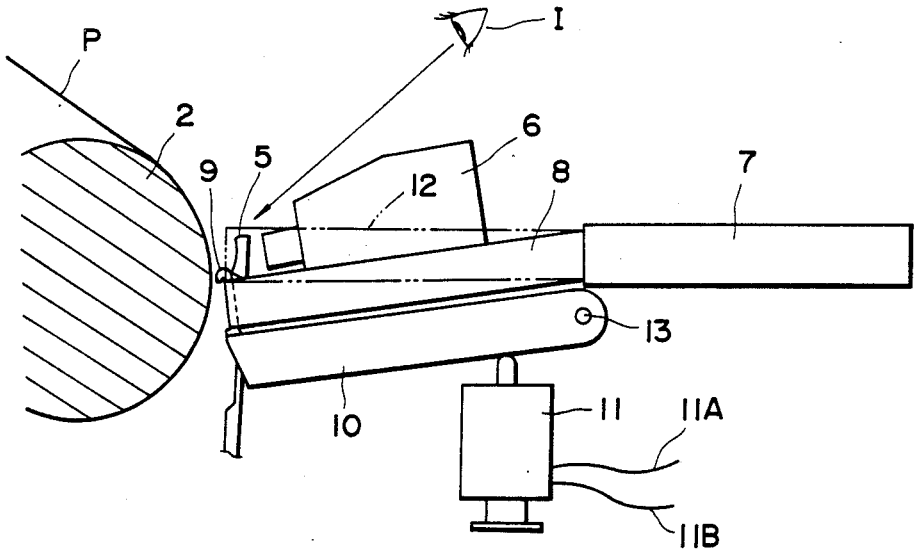
Figure 4:
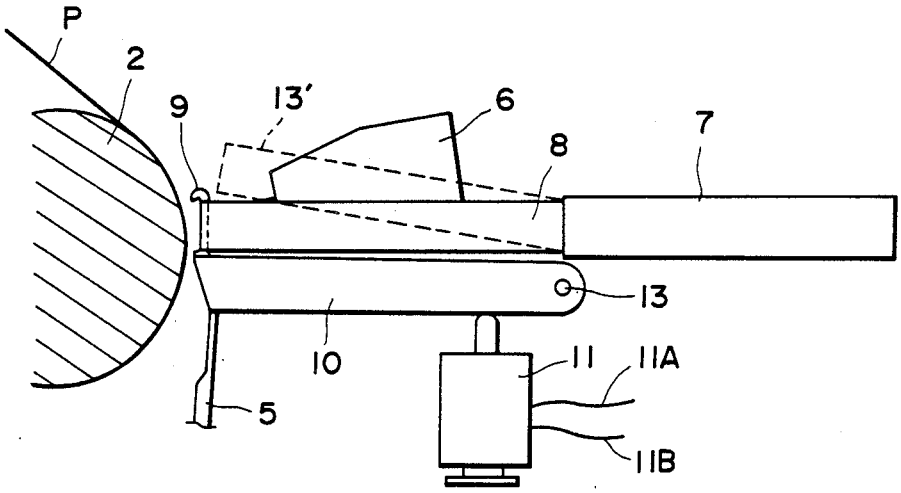

FIGS. 3 and 4 are side views illustrating the structure of the carriage 3 shown in FIG. 2. In FIGS. 3 and 4, a member indicated by reference numeral 2 is the platen, and printing paper P is wound around the platen 2.

A mechanism as illustrated in FIGS. 3 and 4 is mainly arranged on the carriage 3 which reciprocates along the platen 2. More specifically, this mechanism includes a ribbon cassette 7 for housing an ink ribbon 8, a shift arm 10 for vertically shifting the ribbon 8, a daisy wheel 5 as a printing element, and a hammer 6 for striking each type of the wheel 5 so as to print on the printing paper P on the platen 2 through the ink ribbon 8.

The shift arm 10 is coupled to correspond to the width of the ribbon cassette 7 (the other side not shown) and is pivotally supported by a shaft 13. A guide 9 is arranged at the distal end of the shift arm 10. During printing, the shift arm 10 holds the ink ribbon 8 by the guide 9 by driving the solenoid 11, while it shifts the ink ribbon 8 from the position indicated by the solid line (recording confirmation position or recording standby position) to the position indicated by the two dot chain line 12 (recording operation position or ribbon replacement position).

In FIG. 3, the operator's eye is indicated by symbol I. In the non-printing mode, the ink ribbon 8 is at a level indicated by the solid line, so that the operator can observe the printing region of the daisy wheel 5.

In this embodiment, the switch 4 and the solenoid 11 shown in FIG. 2 are interlocked. The solenoid 11 is driven when the hood 1 is opened.

Referring to FIGS. 3 and 4, a signal line 11A connected to the solenoid 11 is a control line for communicating with the control circuit for performing ribbon shift in normal recording operation. A signal line 11B is a control line for operating the solenoid 11 in response to a detection output from the switch 4.

In the above arrangement, when the hood 1 is opened, the switch 4 detects this and its detection output drives the solenoid 11. The solenoid 11 pushes up the shift arm 10. Then, the ink ribbon 8 is moved from the standby position indicated by the solid line in FIG. 3 to the ribbon replacement position indicated by the two dot chain line 12 in FIG. 3.

When the operator opens the hood 1 in this manner in order to replace the ink ribbon, the ink ribbon 8 is automatically shifted up to the ribbon replacement position. Therefore, removal of the ink ribbon 8 from the guide 9, mounting of a new ink ribbon 7 and looping the ribbon 7 around the guide 9 are facilitated. Therefore, the operator need not operate a lever unit or the like to shift up the ink ribbon 8 as in conventional apparatuses, and can easily replace the ink ribbon.

As described above, a conventional apparatus also has a mechanism for detecting the open state of the hood 1. In this embodiment, an output from a similar mechanism is utilized to interlock this mechanism with a drive mechanism for shifting the ribbon. Therefore, the construction of the apparatus is not rendered complex nor expensive.

In the above description, when the ribbon is replaced with a new one, the ink ribbon 8 is shifted up to the recording operation position. However, in order to allow still easier replacement, the ink ribbon 8 can be shifted up to an upper ribbon replacement position indicated by a broken line 13', in FIG. 4. In this case, the projection distance of the actuator for the solenoid 11 can be controlled to be large when the cover is open, or a separate solenoid can be included to allow shift operation of the ink ribbon.

Figure 5:
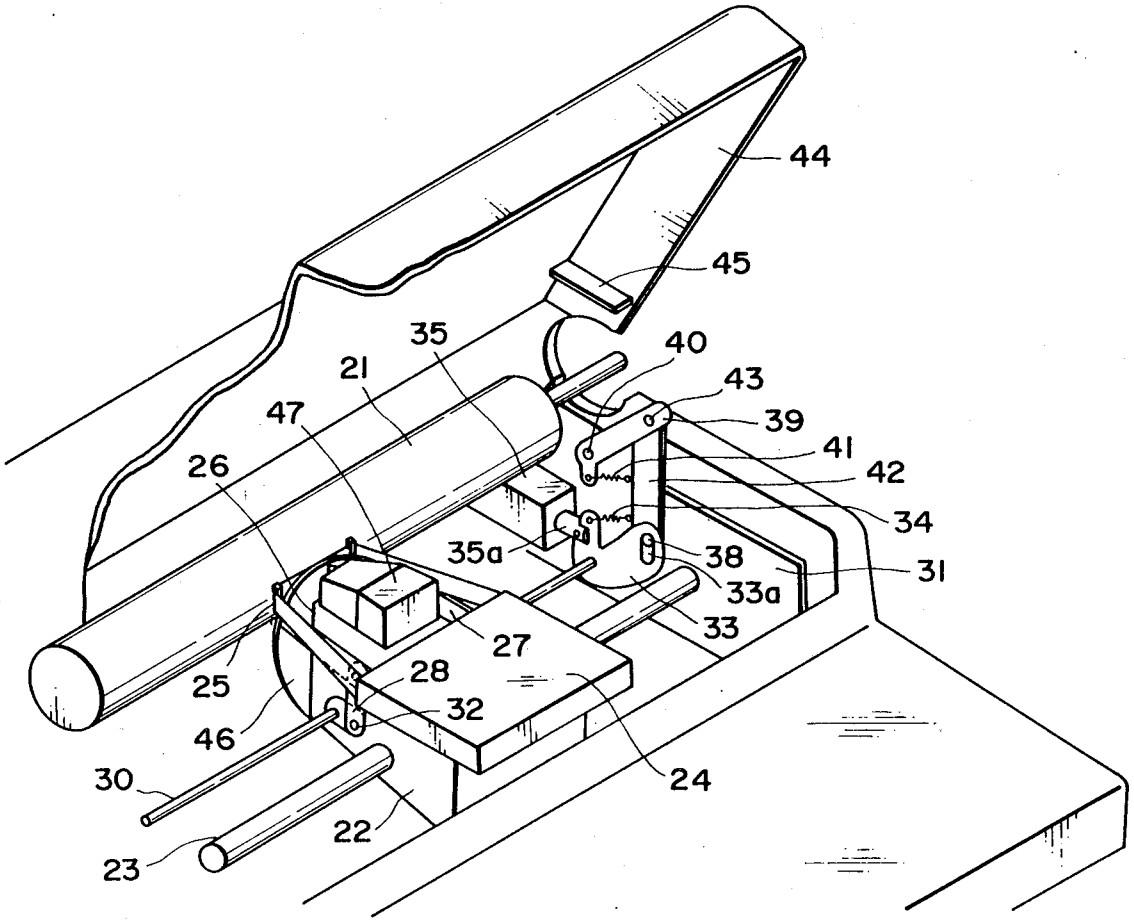

FIGS. 5 to 8 show a second embodiment of the present invention, and FIG. 5 shows the overall structure of this embodiment.

Referring to FIG. 5, a carriage 22 is slidably fitted around a guide shaft 23 parallel to a platen 21.

An ink ribbon cassette 24 is detachably mounted on the carriage 22. An ink ribbon 25 drawn out from one end of the ink ribbon cassette 24 is guided along a pair of ribbon guides 26 and 27 and guide pins **26*a* and 27*b*** arranged at their distal ends, and is then inserted into the other end of the cassette.

Figure 7:
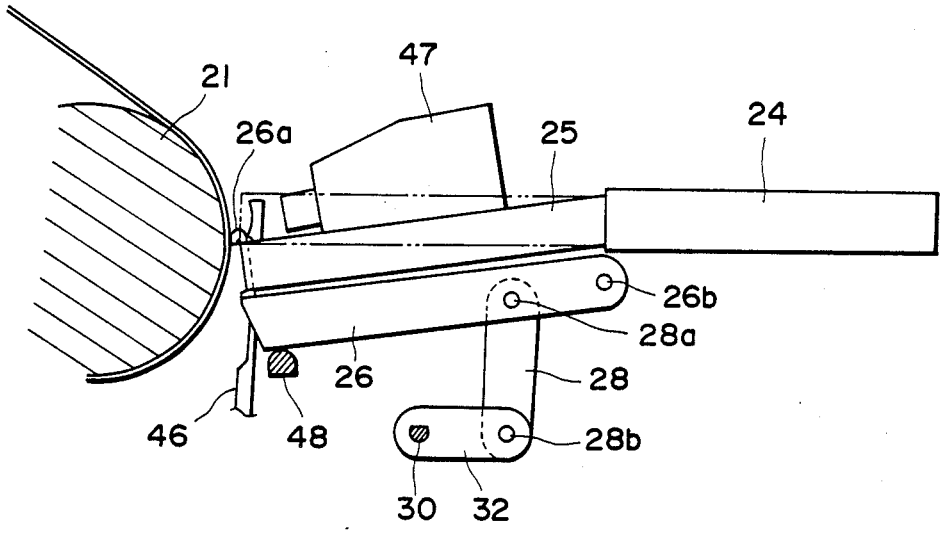

The proximal ends of the ribbon guides 26 and 27 are interlinked by a shaft **26*b* extending through the carriage 22, as shown in FIG. 7. Thus, the two ribbon guides 26 and 27** are interlinked.

A hammer unit 47 is mounted on the carriage 22. A printing element 46 having a daisy wheel structure, for example, is mounted on the end of the carriage 22 at the side of the platen 21. The ink ribbon 25 is passed in a gap between the element 46 and the platen 21.

An actuating shaft 30 has a non-circular section and is arranged between the platen 21 and the guide shaft 23 so as to extend parallel to the platen 21 and to allow slidable movement of the carriage 22. The two ends of the shaft 30 are rotatably supported between side plates 31 (one omitted) of the apparatus in the same manner as the shaft 23.

The upper end of a link lever 28 is pivotally supported through a shaft **28*a* near the proximal end of the ribbon guide 26. The lower end of the link lever 28 is pivotally supported at one end of another link lever 32 arranged horizontally arranged through a shaft 28***b*.

The other end of the link lever 32 cannot rotate but is slidably fitted around the actuating shaft 30.

Figure 6:
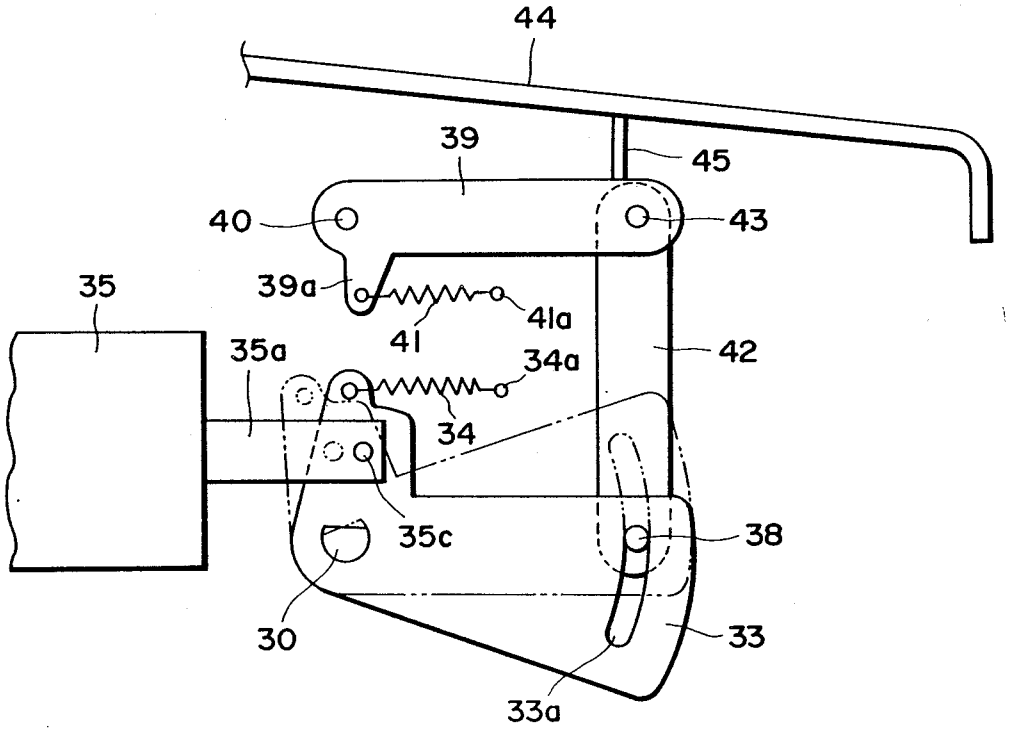

One end of the shaft 30 is coupled to an actuating lever 33 inside the side plate 31. The actuating lever 33 has an L-shape as shown in FIG. 6, and its bent portion has the shaft 30 extending therethrough.

A solenoid 35 is arranged below the platen 21 so as to oppose the actuating lever 33. The distal end of a rod 35*a* of the solenoid 35 is pivotally coupled to one (rear) end of the lever 33 through a pin 35C.

A spring 34 is supported between an end of the lever 33 which is coupled to the rod 35*a* and a pin 34*a* projecting from the side plate at the opposite side to the solenoid 35. The spring 34 biases the lever 33 clockwise in FIG. 6.

An arcuated, elongated hole 33*a* is formed along the periphery (with respect to the actuating shaft 30) at the other end of the lever 33.

A link lever 42 is arranged substantially vertically at a position above the side of the lever 33 at which the elongated hole 33*a* is formed. The lower end of the lever 42 is slidably fitted in the hole 33*a* through a pin 38.

The upper end of the lever 42 is pivotally coupled to the free end of a pivotal lever 39 through a pin 43.

The other end of the pivotal lever 39 is pivotally supported through a pin 40 above the lever 33 at a position which corresponds to the end of the lever 33 which is at the side of the solenoid 35.

A projection 39*a* projects below an end of the lever 39 which is at the side of a shaft 40. A pin 41*a* projects from the side surface of the side plate 31 which opposes the projection 39*a*. A spring 41 is provided between the pins 34*a* and 41*a*. The spring 41 biases the lever 39 counterclockwise in FIG. 6. The biasing force of the spring 41 is set to be larger than that of the spring 34.

An upper cover 44 of the apparatus covers the upper portion of the platen and the carriage and can be opened or closed with respect to the housing. A projection 45 is formed near the pivotally supported portion of the cover 44. The projection 45 contacts the upper side near the distal end of the lever 39 when the upper cover 44 is closed as shown in FIG. 6.

The operation of the apparatus of this embodiment will be described below.

When the upper cover 44 is closed and the solenoid 35 is not actuated, i.e., when the recording apparatus is not operating, the rod 35*a* is free, and the actuating lever 33 is in the state shown by the solid line in FIG. 6 by the biasing force of the spring 34.

At this time, the upper surface of the free end of the lever 39 is pressed by the projection 45 of the upper cover 44. The pivotal lever 39 is biased clockwise in FIG. 6 against the biasing force of the spring 41, and the link lever 42 is at the lower position.

However, since the actuating lever 33 is pivoted clockwise in FIG. 6, the pin 38 is located at the end portion of the hole 33*a*.

In this state, as shown in FIG. 7, the link lever 32 is substantially horizontal, and the link lever 28 is at the lower position. As a result, the distal ends of the ribbon guides 26 and 27 are moved downward, and the ink ribbon 25 is shifted down to the standby position (recording confirmation position).

When printing is started in this state, the solenoid 35 is energized in response to a printing command, and the rod 35*a* is withdrawn. As a result, the actuating lever 33 is rotated counterclockwise in FIG. 6 against the biasing force of the spring 34. The lever 33 is pivoted counterclockwise as in the same manner as the actuating shaft 30, and the link lever 32 is pivoted counterclockwise in FIG. 8, and the link lever 28 is moved upward.

The ribbon guides 26 and 27 are also moved upward and arranged substantially horizontal. The ink ribbon 25 is shifted up to the recording operation position.

Printing is performed in this state.

When shifting up of the ink ribbon is performed by the solenoid 35, the actuating lever 33 is pivoted counterclockwise in FIG. 6. However, the pin 38 at the lower end of the link lever 42 moves within the hole 33*a* and does not apply and upward force to the link lever 42. In other words, the ink ribbon is shifted independently of the link lever 42.

When the ink ribbon is replaced with a new one, the solenoid 35 is not actuated, and the actuating lever 33 is in the state indicated by the solid line in FIG. 6. The ink ribbon 25 is shifted down to the standby position as shown in FIG. 7.

When the upper cover 44 is opened in this state, the pivotal lever 39 is pivoted counterclockwise in FIG. 6 by the biasing force of the spring 41. The link lever 42 is moved upward as shown in FIG. 5. Since the biasing force of the spring 41 is larger than that of the spring 34, the actuating lever 33 is pivoted counterclockwise as indicated by the dashed line in FIG. 6.

Figure 8:
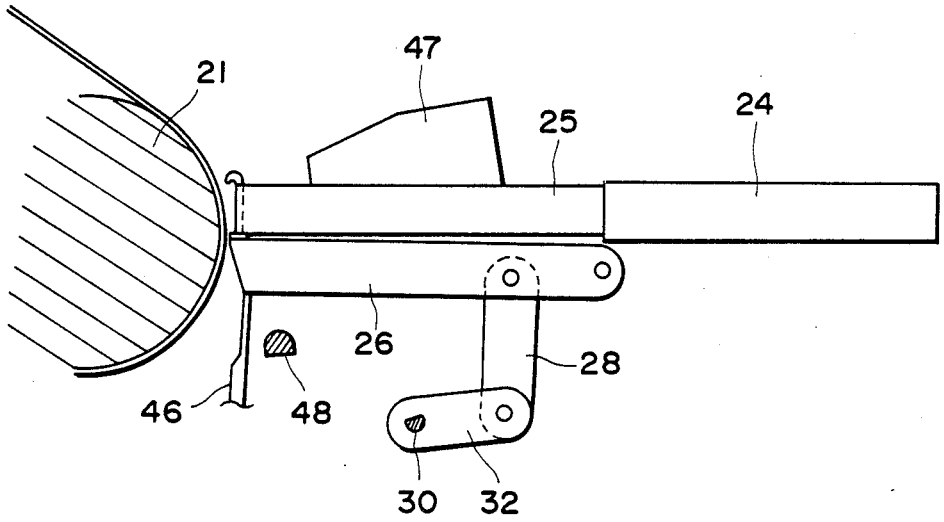

The link lever 32 is pivoted counterclockwise in FIG. 8 through the actuating shaft 30. The distal ends of the ribbon guides 26 and 27 are moved upward through the link lever 28, and the ink ribbon 25 is shifted up to the recording operation position.

In this state, the ink ribbon can be freely replaced.

With a mechanical interlock mechanism described above, only by opening the upper cover 44, the ink ribbon can be shifted irrespective of the ON/OFF state of the power source and the ink ribbon can be replaced.

In the above embodiment, the cassette is not shifted, but the exposed ink ribbon is shifted. However, the cassette can also be shifted together with the ribbon. In the second embodiment, the link mechanism is separated from the upper cover 44. However, the two can be formed integrally with each other.

In the above description, the present invention is applied to an apparatus for printing using a daisy wheel. However, the present invention is not limited to this particular type of recording apparatus and can be similarly applied to other types of recording apparatuses using ink ribbons such as a wire-dot printer or a thermal transfer printer.

What is claimed is:

1. A recording apparatus comprising:

recording means for recording on a recording medium through an ink ribbon in accordance with a predetermined system;

means for coverting said recording means such that said cover means is free to open or close;

first ribbon shifting means including a plurality of ink elements directly coupling said ink ribbon to said cover means for effecting a shifting operation of said ink ribbon by a force of an opening or closing operation of said cover means, said first ribbon shifting means shifting said ink ribbon to a first upper position when said cover means is open and shifting said ink ribbon to a second lower position when said cover means is closed, and second ribbon shifting means connected to one of said link elements for actuating said one of said link elements of said first ribbon shifting means to shift said ink ribbon to said first or second position by electrical force, wherein the shifting operation of said second ribbon shifting means is preferred to that of said first ribbon shifting means.

2. An apparatus according to claim 1, further comprising detecting means for electrically detecting a open/closed state of said cover means, and wherein said second ribbon shifting means shifts the ink ribbon in accordance with a detection result of said detecting means.

3. An apparatus according to claim 1, wherein said first ribbon shifting means includes a first link element urged against said cover means by a first spring and a second link element moved together with said ink ribbon in connection with the shifting operation of said ink ribbon, said second link element being formed with a slot through which a connecting member is connected with a predetermined degree of freedom to said first link element said second link element being connected said second ribbon shifting means.

4. An apparatus according to claim 3, further comprising a second spring for biasing said second link element so that said first link element may engage the slot of said second link element.

5. An apparatus according to claim 1, wherein said second ink ribbon shifting means, when energized by electric power, shifts said ink ribbon to said first upper position.

* * * * *

UNITED STATES PATENT AND TRADEMARK OFFICE

CERTIFICATE OF CORRECTION

PATENT NO. : 4,676,679

DATED : June 30, 1987

INVENTOR(S) : HIROATSU KONDO

It is certified that error appears in the above-identified patent and that said Letters Patent is hereby corrected as shown below:

COLUMN 6

Line 15, "and" (second occurrence) should read --an--.

Line 58, "coverting" should read --convering--.

Line 60, "ink" should read --link--.

COLUMN 7

Line 9, "a" should read --an--.

COLUMN 8

Line 6, "element" (first occurrence) should read --element,--.

Line 7, "said" should read --to said--.

Signed and Sealed this

Sixteenth Day of February, 1988

*Attest:*

DONALD J. QUIGG

*Attesting Officer*

*Commissioner of Patents and Trademarks*